US005360140A

United States Patent [19]

Senghaas

[11] Patent Number: 5,360,140

[45] Date of Patent: Nov. 1, 1994

[54] LOW COST CONTROL CIRCUIT FOR SENSING THE OPERATION OF AN ELECTRICALLY OPERABLE DEVICE

[75] Inventor: Karl A. Senghaas, San Antonio, Tex.

[73] Assignee: The Cornelius Company, Anoka, Minn.

[21] Appl. No.: 907,464

[22] Filed: Aug. 10, 1992

Related U.S. Application Data

[63] Continuation of Ser. No. 648,474, Jan. 31, 1991, abandoned, which is a continuation of Ser. No. 286,438, Dec. 16, 1988, abandoned.

[51] Int. Cl.[5] ..... B67D 5/00

[52] U.S. Cl. ..... 222/52; 222/54; 222/129.1; 222/146.6; 222/644; 338/25; 338/307

[58] Field of Search ..... 222/54, 129.1–129.4, 222/146.6, 644, 52; 338/25, 307

[56] References Cited

U.S. PATENT DOCUMENTS

| | | | |
|---|---|---|---|
| 2,949,137 | 8/1960 | Arnett et al. | 222/54 X |
| 3,221,936 | 12/1965 | Spinuzza | 222/54 |
| 3,570,715 | 3/1971 | Evers | 222/54 |
| 4,055,279 | 10/1977 | Lapera et al. | 222/54 |
| 4,282,507 | 8/1981 | Tindalla et al. | 338/25 |
| 4,535,917 | 8/1985 | Trewhella | 222/146.6 X |
| 4,658,988 | 4/1987 | Hassell | 222/129.1 |
| 4,670,734 | 6/1987 | Caddock | 338/293 X |
| 4,719,441 | 1/1988 | Horn | 338/25 X |
| 4,801,375 | 1/1989 | Padilla | 222/640 X |
| 4,804,112 | 2/1989 | Jeans | 222/146.6 X |
| 4,903,862 | 2/1990 | Shannon et al. | 222/54 |
| 4,909,047 | 3/1990 | Koeneman et al. | 222/146.6 X |
| 4,967,932 | 11/1990 | Wiley et al. | 222/146.6 X |
| 4,969,516 | 11/1990 | Merrill et al. | 222/1 |

*Primary Examiner*—Andres Kashnikow
*Assistant Examiner*—Anthoula Pomrening
*Attorney, Agent, or Firm*—Sten Erik Hakanson

[57] ABSTRACT

A double sided primed circuit board is shown wherein one side is etched for receiving a plurality of surface mounted components constituting a control circuit. In one embodiment the control circuit provides for regulating the operation of a plurality to the beverage dispensing valves. An op-amp monitors the conductor for sensing the operation of the beverage dispensing valves as a function of a voltage drop there across. The conductor operates as a resistor, and any heating thereof that occurs as a result of the operation of the beverage dispensing valves is dissipated over the entire surface area of the circuit board. The control circuit also operates a dump valve for periodically dumping beverage if any of the valves have not been operated for a set period of time. The control circuit deactivates the operation of the dump valve during any sensed operation of one of the beverage dispense valves.

9 Claims, 5 Drawing Sheets

LOW COST CONTROL CIRCUIT FOR SENSING THE OPERATION OF AN ELECTRICALLY OPERABLE DEVICE

This application is a co-pending continuation of application U.S. Ser. No. 07/648,474, filed Jan. 31st, 1991, now abandoned, which was a co-pending continuation of Ser. No. 07/286,438, filed Dec. 16th, 1988, now abandoned.

(1) Field of the Invention

The present invention relates generally to electrical circuits for sensing the operation of an electrically operable device, and in particular to such devices that sense such operation as a function of a voltage drop across a resistor.

(2) Description of the Related Art

Dispensing systems of the prior art utilize electromechanical valves to control the release of carbonated water and syrup or other ingredients from a beverage dispensing machine. The temperature at which the beverage is dispensed and consumed is crucial to the perceived taste thereof. Consequently, the dispensing machine must perform to desired specifications, one of which is delivery of carbonated water at a precisely controlled temperature. To this end, beverage dispensers are equipped with various heat exchangers to facilitate the cooling of the water to be dispensed. This water is distributed to a set of dispensing valves through a delivery manifold. However, since the delivery manifold is positioned downstream from the cooling device, any idle time results in a warming of the liquid in the manifold. To protect against any temperature change in the manifold, the manifold is usually well insulated. Additionally, a dump valve may be added to the manifold. This dump valve is then opened during periods of inactivity at the dispensing valves. The time duration of opening of the dump valve allows for a volume of liquid to be released to a convenient drain, the volume being sufficient to replenish the manifold with properly cooled liquid. However, this dump valve must not be actuated during any periods of use. Activation of the dump valve during a use period would result in a significant drop in the pressure of the cooled manifold liquid at the dispensing valve, and would consequentially result in an undesired change in the proportions of carbonated water delivered relative to the syrup, the "BRIX" setting.

The dispensing valves in the prior art utilize, for example, a resistor of one ohm in series with the solenoids of the dispenser valves to detect the actuation of any one of the solenoids. However, when several of the dispensing valves are simultaneously actuated, this results in a very large current flow through the resistor and a corresponding very large power drop across the resistor. The detecting resistor has had to be very large in order to handle the dissipation of the large power drawn when multiple valves are simultaneously actuated.

OBJECTS OF THE INVENTION

It is an object of the present invention to provide an apparatus to signal the occurrence of dispensing.

It is a further object of the present invention to provide an apparatus which utilizes dimensionally relatively small component parts.

It is a further object of the present invention to provide an apparatus which is extremely reliable, and of simple and cost effective construction.

It is a further object of the present invention that it be readily alterable to provide for various functions as desired by an installer.

SUMMARY OF THE PRESENT INVENTION

The preferred apparatus of the present invention is a double sided printed circuit board which includes a first side bearing surface mounted componentry to perform the method of sensing the occurrence of dispensing. The preferred embodiment includes on the second side of the printed circuit board a plated conductor used as a resistor to sense a voltage drop which is indicative of the activation of an electrically operable device such as a solenoid operated dispenser valve.

These and other features of the invention will be more readily understood upon consideration of the detailed description herein below, which refers to the following described figures.

DETAILED DESCRIPTION OF THE PREFERRED EMBODIMENT

Figure 4:
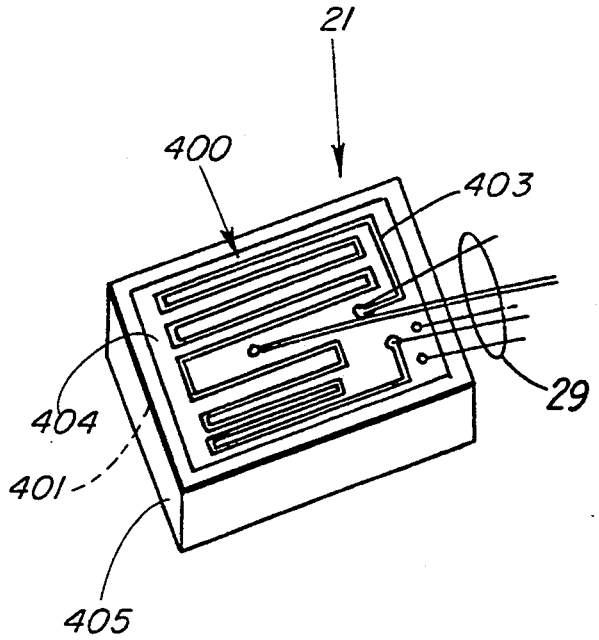
FIG. 4 shows a perspective view of the plated conductor on a printed circuit board.
Figure 1:
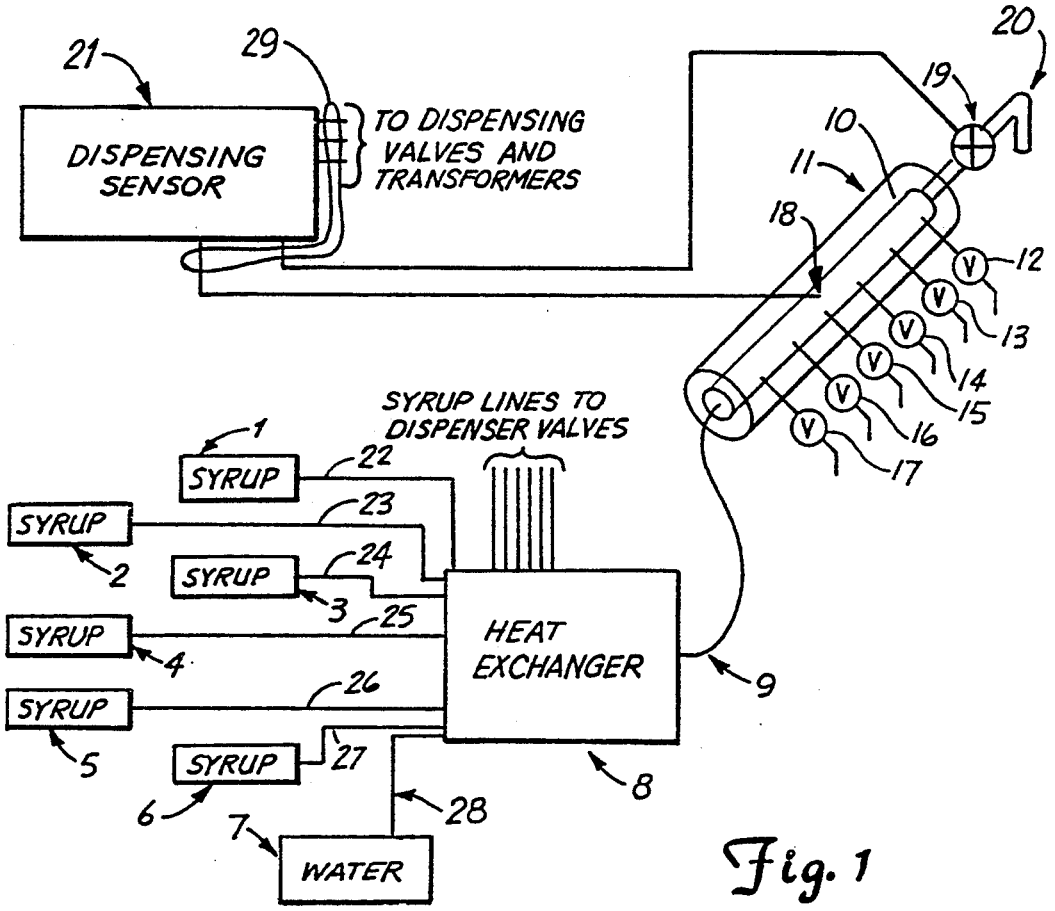
FIG. 1 shows a block diagram of the interconnection of the dispensing sensor in one typical configuration in a beverage dispenser system.
Figure 2A:
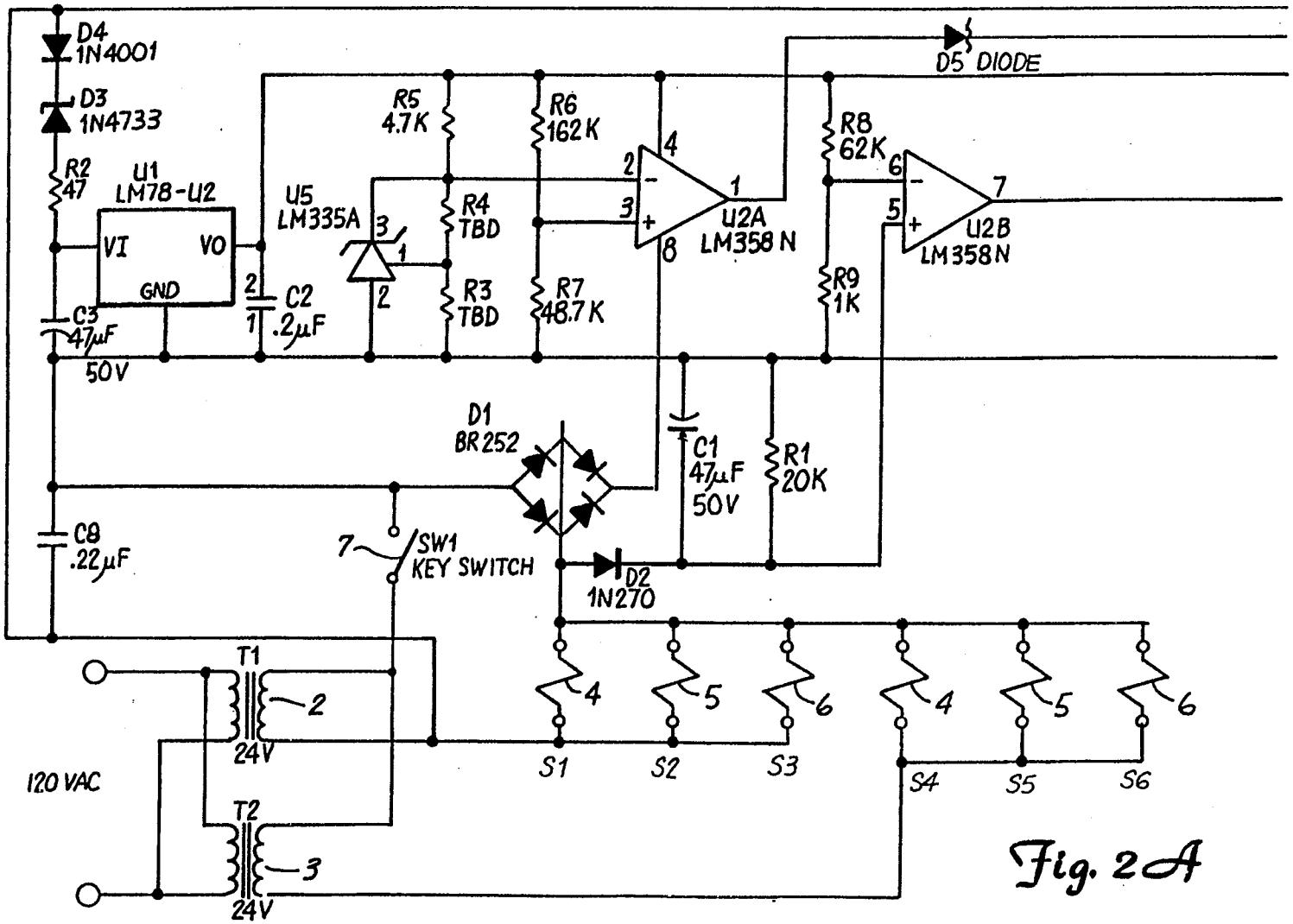
FIGS. 2A and 2B show schematically one embodiment of the dispensing sensor.
Figure 2B:
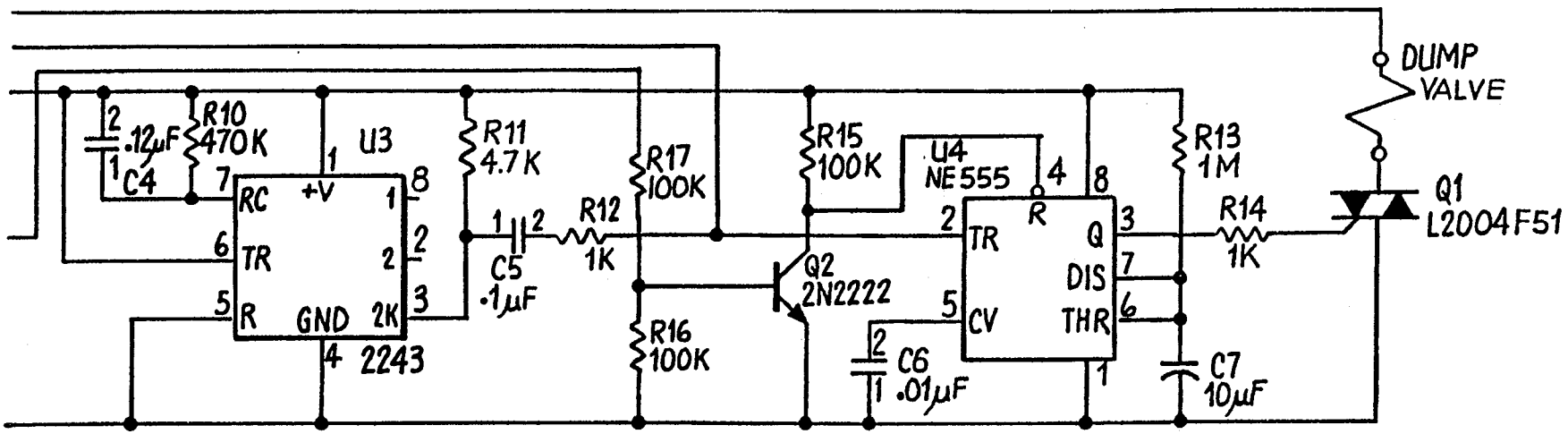
Figure 5:
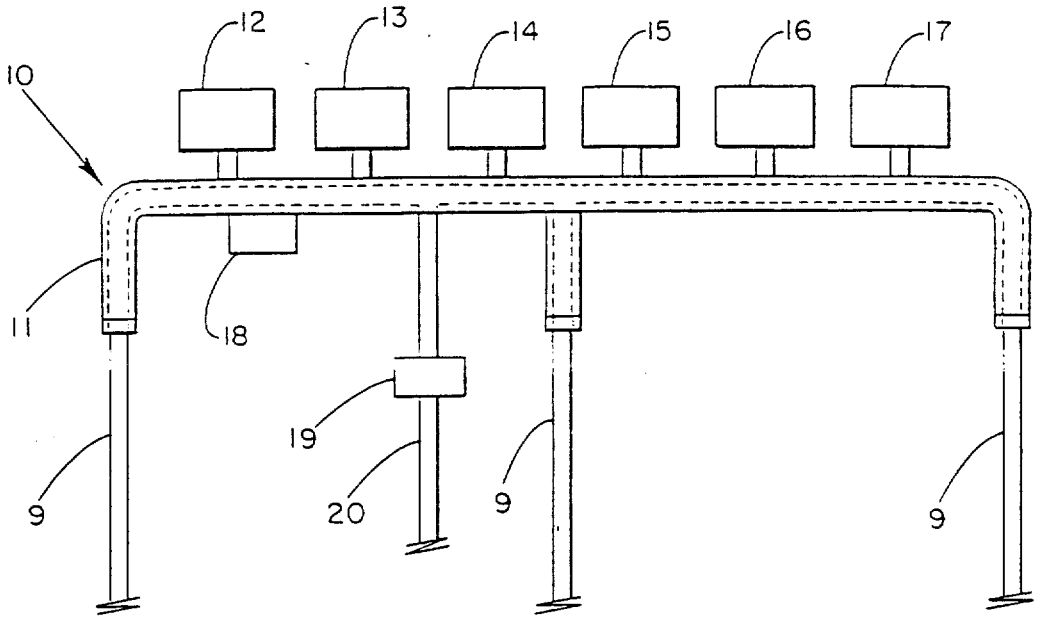
FIG. 5 shows schematically a typical plumbing for the beverage dispenser system of FIG. 1.

The electrical circuit of the present invention can be understood by a particular application thereof in the beverage dispensing arts. Referring to FIGS. 1, 4 and 5, syrup canisters 1-6 provide for various types of beverage syrup concentrate. While six are illustrated, any number of syrup types may be desired. Additionally, water source 7 is provided. This may be a pressurized canister of carbonated water, or a water inlet and carbonation chamber, or other source well known in the art. The syrup canisters 1-6 are connected to heat exchanger 8 via fluid conduits 22-27. Additionally, water 7 is passed through conduit 28 to heat exchanger 8. After cooling to an appropriate temperature, syrups 1-6 are then conducted to the appropriate dispensing valves 12-17 through individual conduits (not illustrated) so as to provide cooled syrup to each appropriate dispensing valve. Water source 7 is connected through conduit 28 to heat exchanger 8 for appropriate cooling of the water, and then through conduit 9 to manifold 10 for common coupling to each of dispensing valves 12-17. Manifold 10 acts as a common distribution source of cooled carbonated water for each mixing and dispensing valve 12-17. Coupled to manifold 10 is a dump valve 19 and outlet 20. Dump valve 19 is actuatable by dispensing sensor 21 to open and close. At desired periods valve 19 is opened to provide a release of carbonated water through outlet 20 from manifold 10 and conduit 9. Outlet 20 may be connected to any suitable receiver, commonly a sink or floor drain. Additionally, manifold 10 includes surrounding thermal insulation 11, and provision for an integrally mounted thermally coupled temperature sensor 18. Dispensing sensor 21 receives information from sensor 18, power and further information from lines 29, and based upon the information received, is operable to actuate valve 19 at appropriate intervals so as to maintain carbonated water of appropriate temperature in manifold 10 at all times. The actual operation of control 21 is best understood from the schematic of FIG. 2. A 120VAC input is provided to 2 UL-Class 2 transformers T1 and T2 converting the 120 volt line to 24 volts. This 24 volt line is available to power the individual dispensing solenoids S1-S6 over a key switch SW1 and individual lever switches or portion controls (not shown). SW1 connects the common of both transformers directly to the Control Circuit Common and over D1 to the Dispense Solenoid Common.

The 24 volt high side is feeding 3 solenoids from each transformer and also the control circuit high side. C8 is a bypass capacitor for interference suppression.

D4, D3, R2, and C3 form a half wave rectifier circuit, charging capacitor C3 to the input voltage level for the 12 volt regulator U1. C2 is for noise suppression. The 12 VDC is now available as a power supply for the control electronics.

LM335 (U5 ) is a temperature sensor located at the manifold. The absolute calibration is set with R3, R4, and R5. The LM358N comparator (U2A) takes its reference over R6 and R7 and receives the manifold temperature on pin 2. As this temperature rises to 40 degrees Fahrenheit, the comparator output flips high and triggers timer U4 over D5. This timer is set to operate for 10 seconds during which pin 3 turns on triac Q1 through R14, enabling the dump solenoid to operate for 10 seconds. Timer U3 is operating in an astable mode with its output pin 3 disabling the trigger (pin 2) of the 10 second timer U4 for some 110 seconds. Thus, as long as the manifold temperature is above the 40 degree setpoint, the dump valve will cycle for 10 seconds every 2 minutes. To prevent this cycling from interfering with the existing "BRIX" setting, a special disable circuit is employed as follows:

D1 (BR252) represents a bridge rectifier utilized as a "constant voltage" drop in the common 24 volt line to the dispense solenoids S1-S6. The AC potential across this bridge is sensed and conducted over a germanium diode D2 and filter network C1 - R1, to the input of comparator U2B. Whenever a drink is drawn, pin 7 of U2B goes high and energizes Q2, which in turn disables (resets) the 10 second timer U4. R10 and C4 are timing elements for U3. C7 and R13 are timing elements for U4.

Figure 3A:
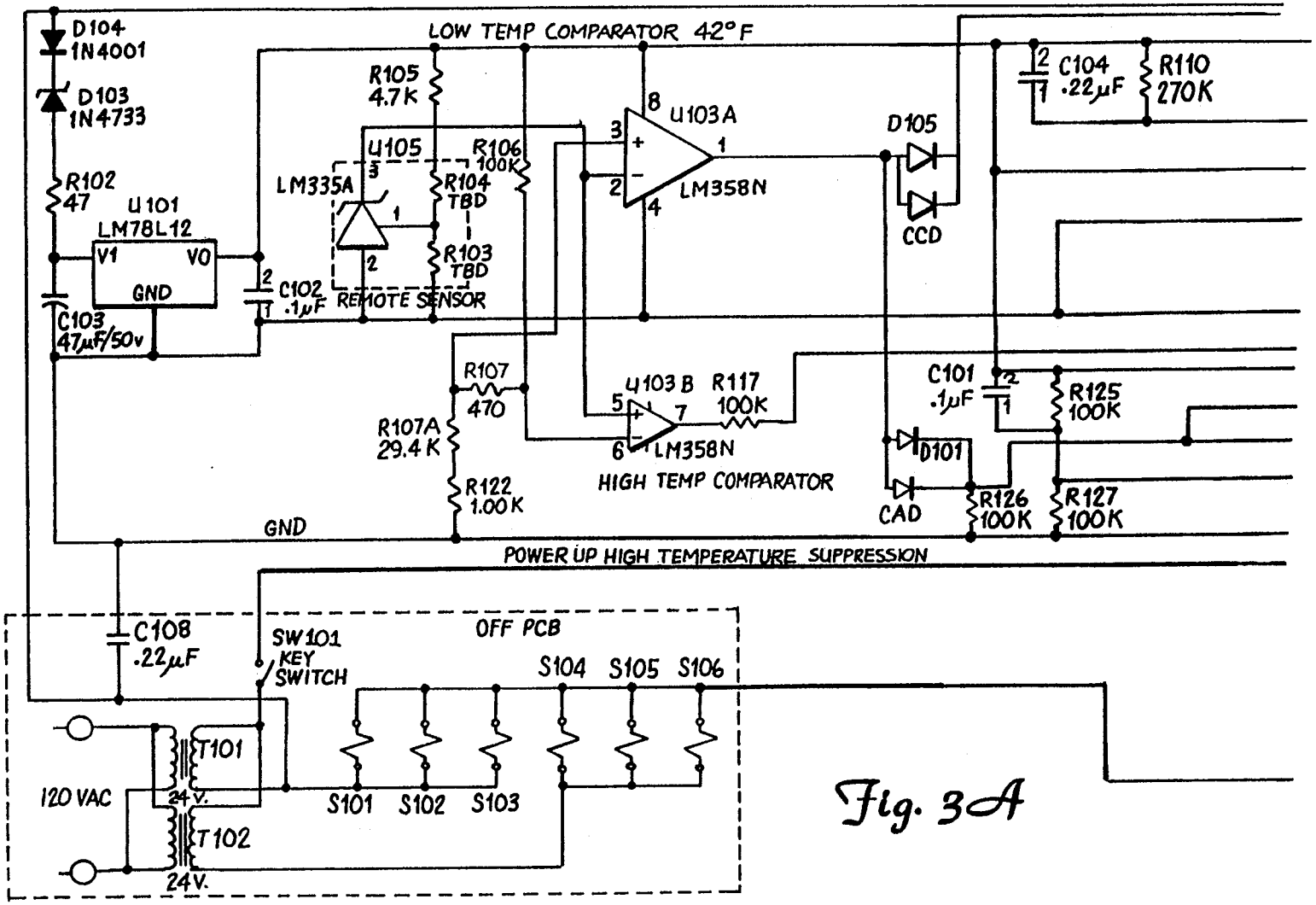
FIGS. 3A and 3B show schematically an alternative embodiment of the dispensing sensor.
Figure 3B:
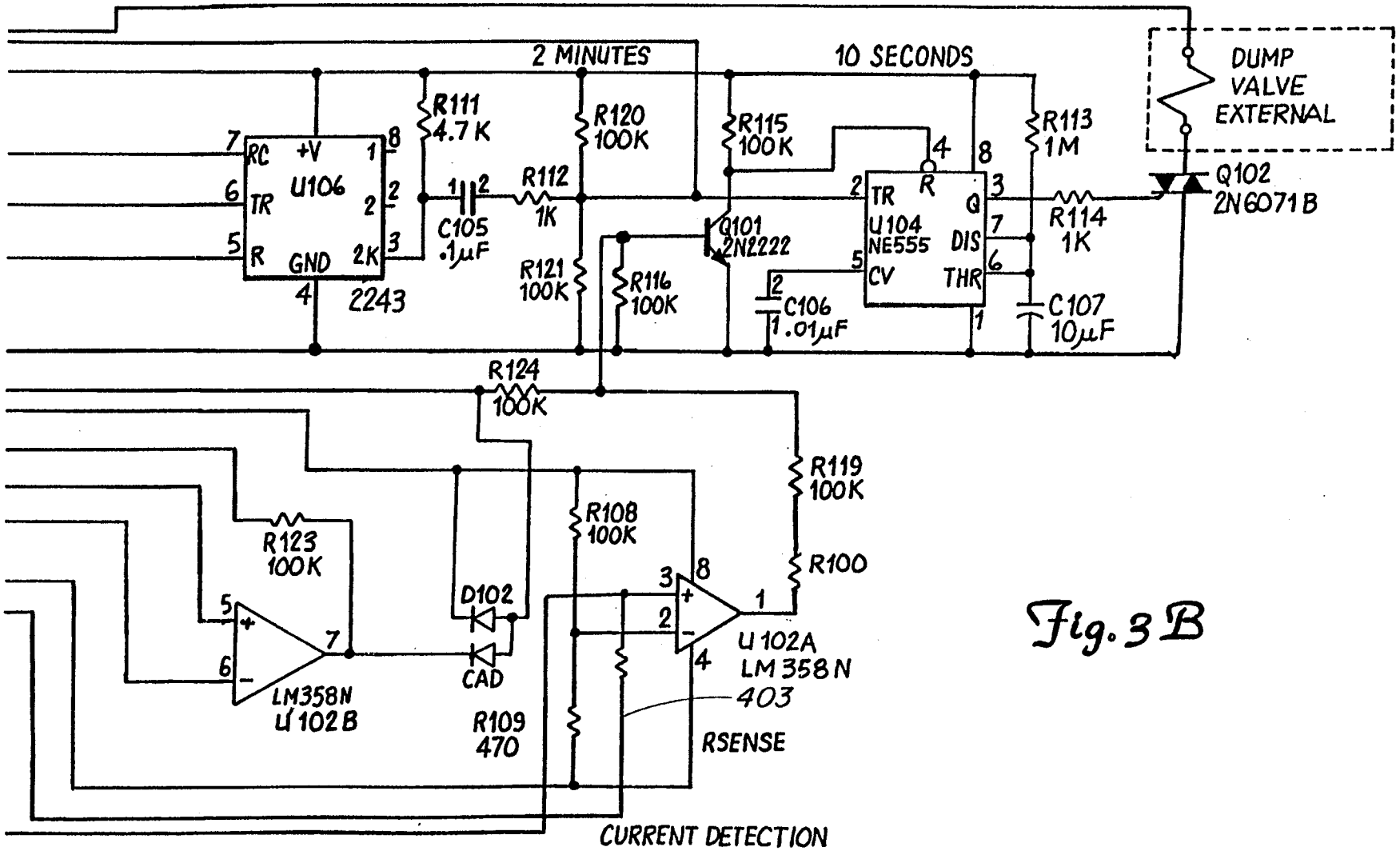

FIG. 3 shows schematically an alternative embodiment of the dispensing sensor 21. A 120 VAC line powers 2 U.L. Class 2 transformers T101 and T102 converting the 120 volt line to 24 volts. The 24 volt line is available to power the individual dispensing solenoids S101-S106 over a key switch SW101 and individual lever switches or portion controls (not shown). SW101 connects the common of both transformers directly to the Control Circuit Common and over D101 to the Dispense Solenoid Common. The 24 volt high sides feeding 3 solenoids from each transformer and also the control circuit high side. C108 is a bypass capacitor for interference suppression.

D104, D103, R102, and C103 form a half wave rectifier circuit, charging capacitor C103 to the input voltage level for the 12 volt regulator U101. C102 is for noise suppression. The 12 VDC is now available as a power supply for the control electronics. LM335A (U105) is a temperature sensor located at the manifold 10. The absolute calibration is set with R103, R104, and R105. The LM 358N comparator U103A takes its reference over R106 and R107 and receives the manifold temperature on pin 2. As this temperature rises to 42 degrees Fahrenheit, the comparator output flips high and triggers timer U104 over D105. This timer is set to operate for 10 seconds during which pin 3 turns on triac Q102, enabling the dump solenoid to operate for 10 seconds.

Timer U106 is operating in an astable mode with its output pin 3 enabling the trigger (pin 2) of the 10 second timer U104. Thus, as long as the manifold temperature is above its 42 degree setpoint, the dump valve will cycle for 10 seconds every 2 minutes. To prevent this cycling from interfering with the existing BRIX setting, a special disable circuit is employed. R sense, 403 as part of the PC board traces and illustrated in FIG. 4, looks at the solenoid current through S101-S106 and drops a small voltage to indicate a "Solenoid On" condition. This signal is presented to U102A on pin 3 which, when compared to a reference signal pin 2, causes pin 1 to go high and disable the 10 second timer over Q101 whenever a drink is drawn.

Another op-amp U103B is wired as a 50 degree fahrenheit comparator, looking at the manifold sensor U105. This comparator disables the dump valve cycling as soon as the manifold temperature increases to 50 degrees. This feature is disabled on a "powerup" condition until the manifold temperature has dropped to 42 degrees.

FIG. 4 shows a projected view of an assembled version of the dispensing sensor 21 shown schematically in FIGS. 3A and B. PC board 400 is a double sided PC board having etched on a first side 401 the circuit pattern for the components, which are generally of the surface mount package style. The use of board first side 401 for circuit traces allows for the tracing of R sense 403 on a second side 404 of PC board 400. Remote correction wires 29 extend from PC board 400 to off board locations. PC board 400 is potted into a container 405 with the use of epoxy or other suitable compounds . The forming of R sense 403 over second side 404 results in several significant advantages over the use of power resistors. These advantages include size reduction, power consumption, reliability, cost, and even dissipation of thermal energy over the entire board 400. Power resistors are of significant bulk, result in isolated heating at the power resistor, and are of significant cost. Additionally, due to the power consumption of power resistors, it is difficult in the present application to obtain a power resistor of appropriate resistance to handle the possibility of either a single or numerous valves being simultaneously energized. Plated conductor 403 will sense from one to a very large number of valves simultaneously, effectively and without excessive power consumption.

FIG. 5 shows schematically one typical arrangement of the plumbing for a dispenser of the type illustrated by block diagram in FIG. 1. Cold carbonated water passes from a refrigeration device through one or more inlets to a plenum or manifold 10. Attached to manifold 10 is temperature sensor 18 and dispensing valves 12–17 (or any number of valves as appropriate). Carbonated water may then be dumped from manifold 10 through solenoid valve 19 in an appropriate drain.

While the foregoing description illustrates the operation of the dispensing sensor as a dump valve actuator, it will be apparent to one familiar with the art that the dispensing sensor can also be utilized as a control circuit with many other functions, such as an ice bank coolant control, a compressor control, a valve monitor for monitoring and accounting of various valve activities such as on-time, on time of each valve individually, time of day valve activity sensing, dump valve activity, etc. These features are derived from the small cost and dimension of the dispensing sensor. The foregoing description of the preferred embodiment of the present invention is in no way intended to limit the breadth of the present invention. Changes or variations which are within the scope of one of ordinary skill in the art are considered to be encompassed within the foregoing description.

Having thus described my invention, I claim:

1. An electronic control circuit for sensing the operation of an electrically operated device, comprising:

a double sided printed circuit board having an electronic control circuit means on a first surface thereof, and a resistance means comprising a plated conductor extending in a meandering pattern over a second surface of the circuit board from a first conductor end to a second conductor end thereof, and the plated conductor electrically connected to each of one or more first electrically operable devices, and the control circuit means including electrical current sensing means, the sensing means electrically connected to the plated conductor for sensing a voltage drop there across resulting from the operating of one or more of the first devices, and the control circuit means connected to a second electrically operable device for controlling the operation thereof, and the control circuit means further including means for preventing the operating of the second device during the sensed operating of one or more of the first devices as determined by the current sensing means.

2. The apparatus as defined in claim 1, and the electronic control circuit means comprising one or more surface mounted components.

3. The apparatus as defined in claim 1, and the one or more first devices comprising beverage dispensing valves and the beverage valves fluidly connected to a manifold and the manifold fluidly connected to a source of cooled beverage for delivering the beverage to the valves, and the second device comprising a normally closed dump valve secured to the manifold for removing beverage from the manifold by opening of the dump valve and the manifold having temperature sensing means secured thereto and connected to the control circuit means for sensing the temperature of the beverage in the manifold, and the dump valve operated by the control circuit means for opening the dump valve when the temperature of the beverage in the manifold exceeds a predetermined first temperature value for removing the beverage from the manifold and for closing the dump valve when the temperature of the beverage in the manifold goes below the first temperature value, and the control circuit means preventing the opening of the dump valve regardless of the sensed temperature during the operating of one or more of the beverage dispensing valves as sensed by the electrical current sensing means.

4. The apparatus as defined in claim 3, and the control circuit means providing for opening of the dump valve for a predetermined first period of time after the lapse of a predetermined second period of time and the second period of time re-started after the lapse of the first period of time and the second period of time re-started each time at least one of the one or more beverage valves is operated so that the dump valve is not operated unless the second period of time has elapsed uninterrupted by the operation of the one or more beverage valves.

5. The apparatus as defined in claim 4, and the control circuit means further including means connected to the temperature sensing means for sensing a predetermined second temperature above the first temperature and for disabling the operating of the dump valve and the one or more beverage valves if the temperature of the beverage in the manifold exceeds the second temperature value.

6. An electronic control circuit for sensing the operation of an electrically operated device, comprising:

a double sided printed circuit board having an electronic control circuit means on a first surface thereof, the control circuit means comprising substantially one or more electronic components of the surface mount type, and a resistance means comprising a plated conductor extending in a meandering pattern over a second surface of the circuit board from a first conductor end to a second conductor end thereof, and the plated conductor electrically connected to each of one or more first electrically operable devices, and the control circuit means including electrical current sensing means, the sensing means electrically connected to the plated conductor for sensing a voltage drop there across resulting from the operating of one or more of the first devices, and the control circuit means connected to a second electrically operable device for controlling the operation thereof, and the control circuit means further including means for preventing the operating of the second device during the sensed operating of one or more of the first devices as determined by the current sensing means.

7. The apparatus as defined in claim 6, and the one or more first devices comprising beverage dispensing valves and the beverage valves fluidly connected to a manifold and the manifold fluidly connected to a source of cooled beverage for delivering the beverage to the valves, and the second device comprising a normally closed dump valve secured to the manifold for removing beverage from the manifold by opening of the dump valve and the manifold having temperature sensing means secured thereto and connected to the control circuit means for sensing the temperature of the beverage in the manifold, and the dump valve operated by the control circuit means for opening the dump valve when the temperature of the beverage in the manifold exceeds a predetermined first temperature value for removing the beverage from the manifold and for closing the dump valve when the temperature of the beverage in the manifold goes below the first temperature value, and the control circuit means preventing the opening of the dump valve regardless of the sensed temperature during the operating of one or more of the beverage dispensing valves as sensed by the electrical current sensing means.

8. The apparatus as defined in claim 7, and the control circuit means providing for opening of the dump valve for a predetermined first period of time after the lapse of a predetermined second period of time and the second period of time re-started after the lapse of the first period of time and the second period of time re-started each time at least one of the one or more beverage valves is operated so that the dump valve is not operated unless the second period of time has elapsed uninterrupted by the operation of the one or more beverage valves.

9. The apparatus as defined in claim 8, and the control circuit means further including means connected to the temperature sensing means for sensing a predetermined second temperature above the first temperature and for disabling the operating of the dump valve and the one or more beverage valves if the temperature of the beverage in the manifold exceeds the second temperature value.

* * * * *

UNITED STATES PATENT AND TRADEMARK OFFICE

CERTIFICATE OF CORRECTION

PATENT NO. : 5,360,140

DATED : November 1, 1994

INVENTOR(S) : Karl A. Senghaas

It is certified that error appears in the above-identified patent and that said Letters Patent is hereby corrected as shown below:

In the Drawings: Add Fig. 5, as shown on attached sheet.

Signed and Sealed this

Nineteenth Day of September, 1995

*Attest:*

Bruce Lehman

BRUCE LEHMAN

*Attesting Officer*

*Commissioner of Patents and Trademarks*